United States Patent [19]

Miranker

[11] 3,945,096

[45] Mar. 23, 1976

[54] PROCESS FOR REMOVING SEPARATING THREAD FROM A WEB OF KNITTED GARMENT PORTIONS OR THE LIKE

[76] Inventor: Samuel Miranker, 4091 Bedford Ave., Brooklyn, N.Y. 11229

[22] Filed: Aug. 5, 1974

[21] Appl. No.: 494,975

Related U.S. Application Data

[63] Continuation-in-part of Ser. No. 343,852, March 22, 1973, abandoned.

[52] U.S. Cl. ..... 28/76 T; 28/72 CS; 66/147; 83/53

[51] Int. Cl.[2] ..... D06H 7/02; D06H 7/22

[58] Field of Search ..... 28/72 CS, 76 T; 83/53, 83/177; 66/147

[56] References Cited

UNITED STATES PATENTS

| | | | |
|---|---|---|---|
| 2,437,735 | 3/1948 | Getaz | 28/76 T UX |
| 2,969,580 | 1/1961 | Wyner | 28/72 CS |
| 3,036,358 | 5/1962 | Scaglia | 28/72 CS X |

*Primary Examiner*—Robert R. Mackey
*Attorney, Agent, or Firm*—Ostrolenk, Faber, Gerb & Soffen

[57] ABSTRACT

Knitted garment portions are manufactured in a continuous web of such portions, with each garment portion being attached to the succeeding garment portion in the web by a separating thread that is intended to be subsequently removed; in accordance with the invention, the separating thread is made of a heat sensitive filament which melts or is destroyed when heat is applied, thereby separating the garment portions; heated air is directed at an oblique angle to downstream motion of the web and melts the separating thread on the trailing edge of each garment portion.

6 Claims, 3 Drawing Figures

PROCESS FOR REMOVING SEPARATING THREAD FROM A WEB OF KNITTED GARMENT PORTIONS OR THE LIKE

This is a Continuation-in-Part of application Ser. No. 343,852, filed Mar. 22, 1973 now abandoned.

This invention relates to a method for separating garment portions that were originally manufactured in the form of a continuous web, and particularly to a method for removing the separating thread between neighboring knitted garment portions which are produced in a continuous web by a continuous knitting machine.

BACKGROUND OF THE INVENTION

Knitted garments are manufactured in separate portions, such as the body of a sweater or shirt, the collar, sleeve, cuff, etc. Complete garments are thereafter stitched together from various portions. A continuously operating knitting machine is programmed to produce a continuous web comprised of succeeding identical garment portions, e.g. a continuous web of knitted shirt collars, with succeeding garment portions being joined by a knitted-in separating thread.

Each garment portion has a finished and an unfinished edge. The finished edge is the one exposed to view when the garment portion is assembled in the completed garment, e.g. the edge of a cuff. The unfinished edge is sewn into the seam joining the garment portion to the remainder of the garment.

A knitting machine may use one or more spools or supplies of yarn or thread. A predetermined number of rows of a particular color or type of yarn or thread is knitted. Then the knitting machine may switch to another type of yarn or thread and continue the knitting process. Upon completion of a single garment portion in a continuous web of garment portions, the knitting machine is programmed to finish the edge of the garment portion in the web to make the finished edge so that it will not unravel. Then, without interrupting the continuous knitting process, the machine switches to what is known in the art as a spearating thread, and one or more rows of separating thread is knitted. Thereafter, the machine switches back to the original yarn and begins knitting the next garment portion in the web starting at the edge of that portion which is raw and unfinished. Each succeeding garment portion in the web is thus joined to the respective preceding garment portion by separating thread. The continuous web is wound on a beam and the beam is brought to where garments are to be made.

Before garments are manufactured from the garment portions produced in the continuous web, the separating thread between adjacent garment portions must be removed. It is conventional to manually remove the separating thread by pulling it out and/or unraveling the separating thread, or to perform this removal and/or unraveling procedure semi-automatically, with an operator holding the garment while the separating thread is pulled out.

Because of time delays associated with the manual or semi-automatic steps in removing separating thread, it is also known to form the separating thread out of a material that is soluble in water or other appropriate fluid. The web of garment portions is passed through heated, even boiling, water or other appropriate solvent and the correspondingly selected separating thread is melted and dissolves away leaving the separate, but not wet and perhaps somewhat damaged, garment portions. An appropriate drying procedure is thereafter needed, requiring expenditure of extra time and effort.

Finally, it is known to form the separating thread of a material that deteriorates in the presence of heat. Attempts have been made to develop a dry process using such a separating thread formed from a specially developed synthetic filament. With the application of hot air or radiant heat, the thread would melt or materially deteriorate so as to separate the knitted garment portions. This has led to the significant problem of the presence of a separating thread residue on the finished (upstream) edge of all of the separated garment portions. In addition to eliminating the residue on the finished edge of the garment portion, it is advantageous to use a synthetic material for the separating thread whose melt temperature is lower than that of the yarn used to form the garment portion. This would, of course, be a problem in connection with garment portions of synthetic filament yarns.

SUMMARY OF THE INVENTION

It is the primary object of the present invention to temporarily join garment portions in a web by use of a separating thread and to thereafter simply and effectively remove the separating thread.

It is another object of the invention to remove the separating thread without leaving any residue of separating thread on the finished edge of a garment portion.

It is further object of the invention to realize the foregoing objects using any of a wide variety of commercially available, low temperature filaments as separating thread.

These and other objects will become apparent from the following summary and detailed descriptions of the invention.

In accordance with the invention, any of a wide variety of separating threads for knitting garment portions together is selected. The separating thread must have the characteristic that it melts or is otherwise destroyed in the presence of heat and it is preferable that the separating thread melt or destruction temperature is below the temperature which will adversely affect the knitted garment portions which the separating thread joins. For example, a low temperature nylon filament manufactured and sold by Monofilament Company of Waynesboro, Virg. Va. be used. A conventional continuous web of garments portions, preferably knitted garment portions, is formed. The garment portions are conventionally joined by separating thread, e.g. by a continuous knitting process of the garment portions and the separating thread. The web is arranged so that the finished edge of each garment portion is its trailing or upstream edge and the unfinished or raw edge of the garment portion is its leading or downstream edge as the web is moved.

The web passes through an oven wherein the web is subjected to a continuous blast of hot air. The blast of hot air is oriented to impinge upon the web moving through the oven in the downstream direction and more particularly the blast of hot air impinges upon the web obliquely to its direction of extension and movement through the oven and generally in a downstream direction. The heated air is directed at an oblique angle to the direction of travel of the web through the oven so that the heated air initially impinges mostly on the upstream or trailing finished edge of the garment portion. With a slight tensioning of the web, the separating thread is parted at the finished edge of each garment portion, leaving all of the filament residue on the unfinished edge of the succeeding garment portion. The unfinished edge of each garment portion is eventually seamed together with an adjoining other garment portion on the garment. The filament residue is tucked in and incorporated into the finished seam, so that it cannot be seen. Means are provided for moving the continuous web into the oven, for moving the web and garment portions through the oven, for tensioning the web as it is subjected to hot air and for collecting the separated garment portions after they exit from the oven.

There is coordination of the precise type of separating thread filament used, its thickness, the length of the path of travel of the web while it is being exposed to the blast of hot air, the time of exposure of each section of the web to hot air, the heat sensitivity of the yarn used in manufacturing the garment portions, and the temperature of the air impinging upon the web moving through the oven all so as to desirably melt the separating thread and to clear all residue of separating thread from the trailing, finished edge of each garment portion. The foregoing method and apparatus are beneficial in that the garment portions are kept dry because no liquid or solvent is needed to remove the separating thread.

BRIEF DESCRIPTION OF THE DRAWINGS

The foregoing will be better understood from the following description of the accompanying drawings, in which.

DETAILED DESCRIPTION OF THE INVENTION

Figures 1, 2, 3:
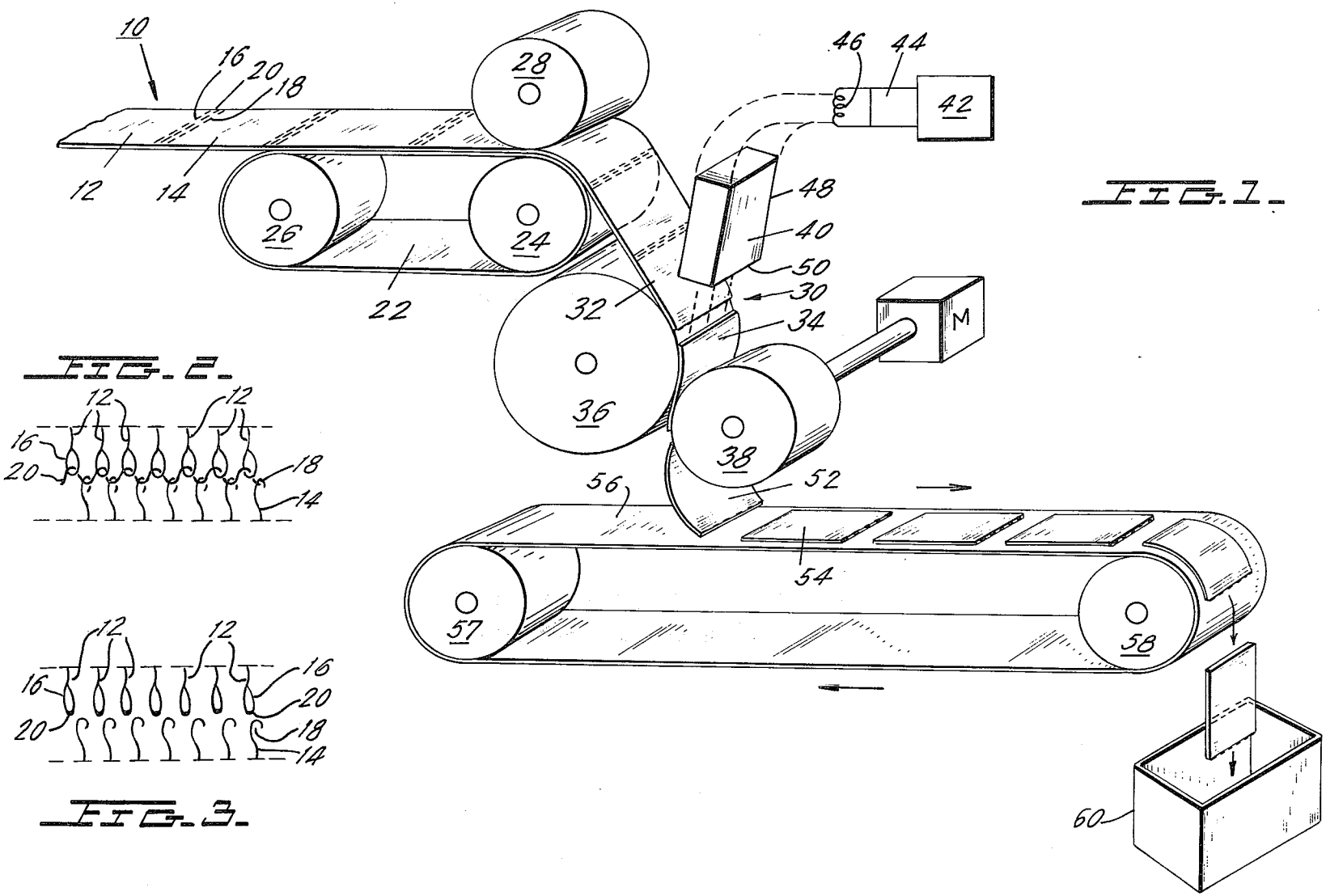
FIG. 1 is a schematic perspective view showing an apparatus in accordance with the invention for practicing the method in accordance with the invention.
FIG. 2 is a representation of the connection by means of separating thread between two neighboring garment portions before the garment portions have been operated upon in accordance with the invention.
FIG. 3 is a representation of the same garment portions after they have been operated upon in accordance with the invention.

By means of a standard knitting machine (not shown), a continuous web 10 of garment portions 12, 14, and the like have been knitted. Turning to FIG. 2, garment portion 12 has a downstream or leading edge 16 which is its unfinished edge. Garment portion 14 has an upstream or trailing edge 18 which is its finished edge that should be free of any residue of separating thread.

At least one row of separating thread 20 has been knitted between unfinished edge 16 and finished edge 18. There may may be additional rows of separating thread for enlarging the space between edges 16 and 18 for better access to hot air or for other reasons, although the more separating thread that is used, the more residue that remains after operating upon the web according to the invention. The separating thread is formed of a low temperature filament, e.g. low temperature nylon.

Returning to FIG. 1, web 10 of attached garment portions is unwound, and is then moved toward the heating means described below by belt 22, which belt is driven by roller 24 and is carried on idler roller 26. Roller 24 and belt 22 cooperate with and rotate with roller 28. Roller 28 is biased toward roller 24 to engage the web at the nip of the rollers and pull web 10 therebetween, thereby to move the web of garment portions into heating zone 30. Rollers 24 and 28 are driven by conventional means to rotate past each other at the same rate. In heating zone 30, garment portions 32, 34 move over guiding and supporting roller 36 which is driven with, cooperates with and is biased against roller 38. Conventional drive means (not shown) drive rollers 36, 38 so that they move at the same rate at their nip or point of contact. Preferably, the rate of motion at the nip of rollers 36, 38 is slightly greater than the rate of movement at the nip of rollers 24, 28 so as to draw the neighboring garment portions, here shown as 32, 34, apart.

In heating zone 30 is located hot air blowing heating means 40, which comprises a conventional fan 42 that blows heated air through a conduit 44 in which there is a heating means 46 to heat the flowing air. The now heated air moves into duct 48 which has an outlet 50 of sufficient width to extend at least across and preferably a little wider than the greatest width portion of garment portions 32, 34 and which has a length along the direction of extension of the garment portions sufficient to allow hot air to be blown against the web to melt the separating thread 20 between neighboring garment portions to the desired extent.

What is significant about duct 48 and its outlet 50 is the orientation thereof with respect to the web as the web moves past the duct. The duct is oriented so that the blown hot air is directed at an angle transverse to the web, oblique to the direction of extension of the web as it moves past the duct so that the air is directed to impinge directly upon the finished edge of a pair of cooperating edges that have been joined by separating thread. In the usual situation illustrated herein, the finished edge of a garment portion, such as portion 14, is its upstream or trailing edge 18 and duct 48, 50 is therefore oriented to deliver hot air obliquely downstream and, therefore, principally against the finished edge of each garment portion. As the web is moving in the downstream direction, it is preferable that the blast of air be obliquely downstream, in cooperation with the direction of movement of web 10 through the heating zone. In an alternate arrangement, it may be more preferable to have the web arranged so that the finished edge of each garment portion is its downstream or leading edge rather than its upstream or trailing edge and the oblique orientation of the hot air duct would, therefore, be altered so that the duct is blowing air upstream, rather than downstream.

FIG. 3 depicts what will happen to garment portions 12, 14 after they have moved past duct 48, 50. The heated air from duct 48, 50 is directed to cause the separating thread 20 to melt and deteriorate on the finished, trailing edge 18 of garment portion 14. At the same time, cooperating rollers 36, 38 are drawing the leading or downstream garment portion 14 away from the trailing garment portion 12. The direction of the heated air cooperates with the movement apart of the garment portions to leave the residue of separating thread 20 on the unfinished edge 16 of the trailing garment portion 12. The separation of the garment portions is now completed and the residue is all away from the finished edge 18 of garment portion 14.

Returning to FIG. 1, the now separated garment portions 52, 54, etc. fall or are deposited upon conventional conveyor 56, which is operated by rollers 57, 58 which are conventionally driven (by means not shown)

and which carry the garment portions to and deliver them to receptacle 60. The garment portions are now ready for further processing into complete garments.

There has just been described one embodiment of an apparatus for and of a method for automatically removing any heat destructible separating thread that is between adjacent garment portions in a continuous web of such portions, without any manual operations being required in the separating procedure, and without having to wet or otherwise adversely affect the condition of the garment portions and leaving the finished edge of each garment portion free of residue. the foregoing is accomplished by providing a separating thread of heat disintegratable material, moving the continuous web of garment portions held together by separating thread past the heating zone and blowing heated air at an oblique angle to the web and oriented to impinge directly upon the finished edges of each garment portion, thereby to disintegrate the separating thread while freeing the finished edge of each garment portion of any residue.

Although the present invention has been described in connection with a preferred embodiment thereof, many variations and modifications will not become apparent to those skilled in the art. It is preferred, therefore, that the present invention be limited not by the specific disclosure herein, but only by the appended claims.

I claim:

1. Process for removing the separating thread that is between garment portions, the garment portions having been manufactured in the form of a continuous web of garment portions, with each garment portion having a finished edge and an unfinished edge, and each garment portion finished edge being joined to the unfinished edge of the neighboring garment portion by separating thread, and the separating thread being of the type to be destroyed by heat, said process comprising:

moving the web through a heating zone generally along a particular direction;

heating air to a temperature sufficient to destroy the separating thread and blowing the heated air from a source above the surface of the web against a surface of the web to define the heating zone and controlling the air flow so as to form a stream of heated air that is concentrated over a relatively short length of the web along the particular direction and over the entire width of the web and the entire stream being controlled to blow in a direction that is obliquely transverse to the particular direction of the web and such that the heated air is aimed to strike the finished edge of each of the garment portions that is joined by separating thread thereby initially destroying the separating thread on the finished edge of each previously joined garment portion such that the separating thread recedes from the finished edge and the residue of the separating thread remains on the unfinished edge of each previously joined garment portion.

2. The process of claim 1, wherein the web moves through the heating zone at a first speed; the further step of drawing the downstream one of the joined garment portions in the particular direction faster than said first speed of the web moving through the heating zone.

3. The process of claim 1, wherein before moving the web through the heating zone, both the web and the garment portions are oriented such that the finished edge of each garment portion is its trailing, upstream edge with respect to the particular direction and the unfinished edge of the garment portion is its leading, downstream edge;

the air being blown in a direction oblique to the direction of extension of the web and downstream of the web with respect to the particular direction.

4. The process of claim 3, wherein the web moves through the heating zone at a first speed; the further step of drawing the downstream one of the joined garment portions in the particular direction faster than said first speed of the web moving through the heating zone.

5. The process of claim 3, wherein the length in the particular direction of the heating zone, the air temperature of the air being blown in the heating zone, the nature and thickness of the separating thread and the speed of movement in the particular direction of the web are all selected to destroy the separating thread in the heating zone.

6. The process of claim 1, wherein the garment portions are formed by knitting and the separating thread is knitted between neighboring, succeeding garment portions in the web.

* * * * *